US009680196B2

(12) United States Patent
Yoon

(10) Patent No.: US 9,680,196 B2
(45) Date of Patent: Jun. 13, 2017

(54) ON-CHIP DIFFERENTIAL WILKINSON DIVIDER/COMBINER

(71) Applicant: Avago Technologies General IP (Singapore) Pte. Ltd., Singapore (SG)

(72) Inventor: Seunghwan Yoon, Irvine, CA (US)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 7 days.

(21) Appl. No.: 14/924,561

(22) Filed: Oct. 27, 2015

(65) Prior Publication Data

US 2017/0069949 A1 Mar. 9, 2017

Related U.S. Application Data

(60) Provisional application No. 62/214,753, filed on Sep. 4, 2015.

(51) Int. Cl.
*H01P 5/12* (2006.01)

(52) U.S. Cl.
CPC ..... *H01P 5/12* (2013.01)

(58) Field of Classification Search
CPC ..... H01P 5/12
USPC ..... 333/100, 124–129, 132, 134, 136
See application file for complete search history.

(56) References Cited

U.S. PATENT DOCUMENTS 7,646,262 B2 * 1/2010 Kannell ..... H03H 7/38 333/100
8,648,669 B1 * 2/2014 Podell ..... H01P 3/003 333/125
2011/0063048 A1 * 3/2011 Floyd ..... H01P 5/16 333/136

* cited by examiner

*Primary Examiner* — Robert Pascal
*Assistant Examiner* — Kimberly Glenn
(74) *Attorney, Agent, or Firm* — Sterne, Kessler, Goldstein & Fox P.L.L.C.

(57) ABSTRACT

The present disclosure provides for a fabrication layout and design for transmission lines that are implemented as part of a differential Wilkinson power divider/combiner. The transmission lines are configured and arranged in a poly-loop line geometry. The poly-loop line geometry includes overlapping transmission lines to route differential signals within the differential Wilkinson power divider/combiner. The overlapping transmission lines each include a crossover region to route the differential signals. The crossover represents a spacing between the overlapping transmission lines that encompasses a magnetic flux of the overlapping transmission lines.

20 Claims, 10 Drawing Sheets

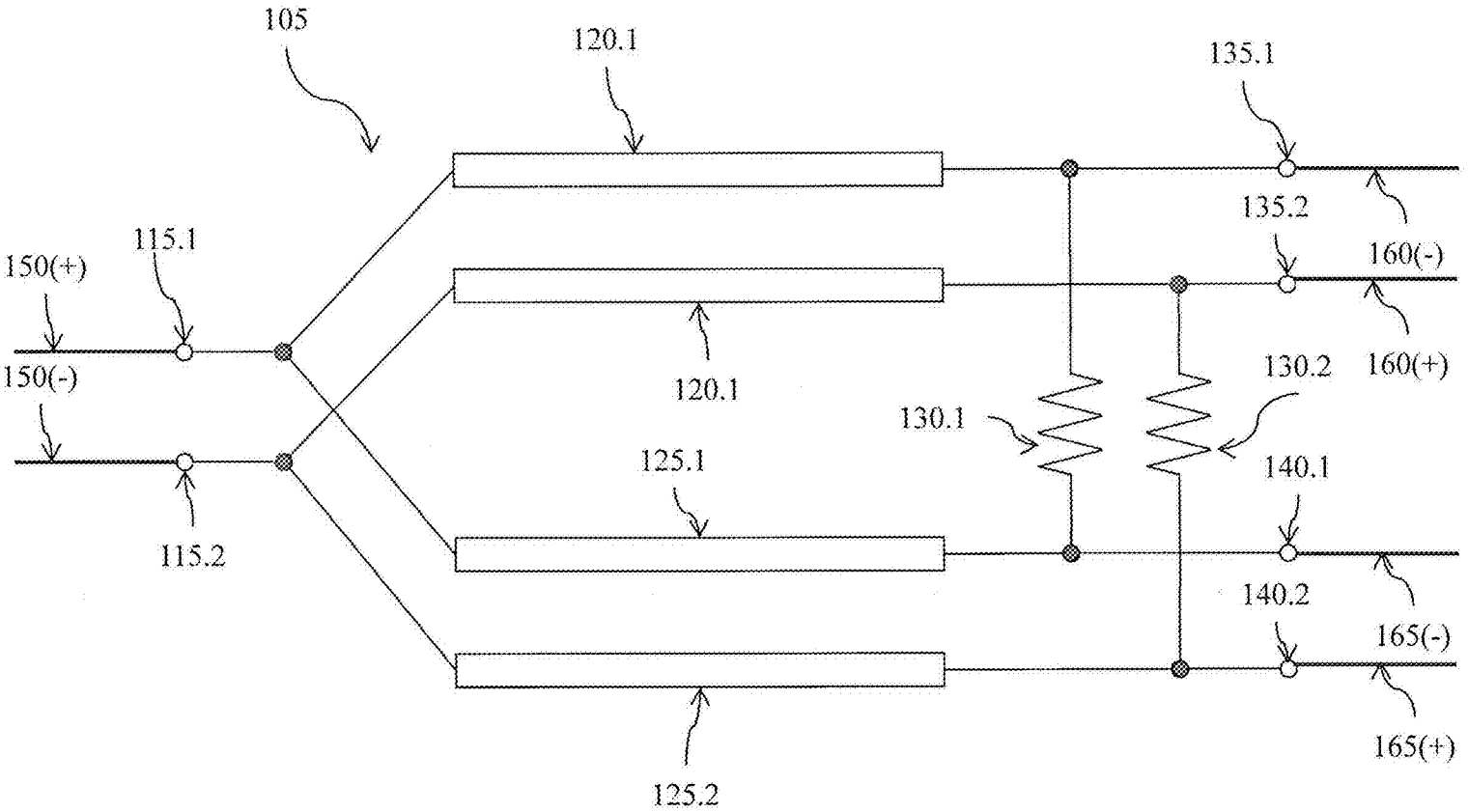
FIG. 1
CONVENTIONAL

305

ON-CHIP DIFFERENTIAL WILKINSON DIVIDER/COMBINER

CROSS REFERENCE TO RELATED APPLICATIONS

This application claims the benefit of U.S. Patent Application No. 62/214,753, filed on Sep. 4, 2015, which is incorporated herein by reference in its entirety.

BACKGROUND

Field of Disclosure

The disclosure relates to a Wilkinson power divider/combiner, including a Wilkinson power divider/combiner having a poly-loop line geometry.

Related Art

There exists an ever-increasing supply of, and demand for, broadband multimedia applications calling for an ever-increasing capacity of wireless networks. The 60-GHz band is a free/unlicensed band, which features a higher frequency and a higher data rate, but is less crowded than, for example, the 38.6-40.0 GHz band. A conventional transmitter often includes one or more CMOS amplifiers that deliver "narrow-band" radio frequency (RF) power to a 50-ohm antenna. However, these CMOS amplifiers do not generate an output with enough signal strength to radiate RF power at the 60 GHz band. To alleviate this, RF signals can be split to individual medium power amplifiers, and antennas, which are connected to the amplifiers and can be used to radiate the split RF signals.

BRIEF DESCRIPTION OF THE DRAWINGS/FIGURES

Embodiments of the disclosure are described with reference to the accompanying drawings. In the drawings, like reference numbers indicate identical or functionally similar elements. Additionally, the left most digit(s) of a reference number identifies the drawing in which the reference number first appears.

FIG. 1 illustrates a differential Wilkinson power divider/combiner.

Figure 4A:
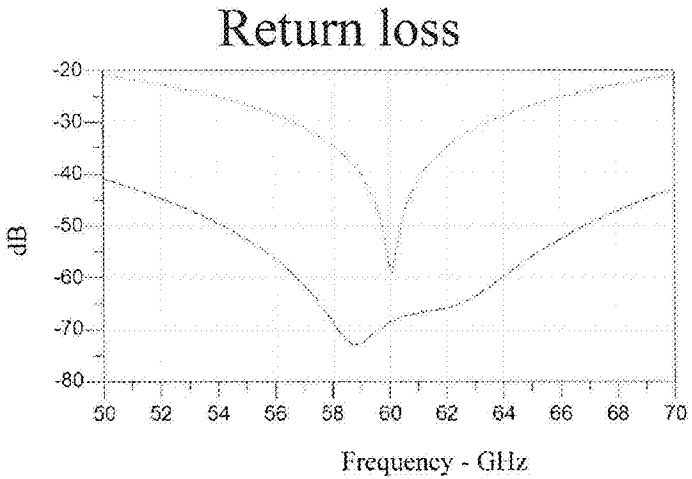
Figure 4B:
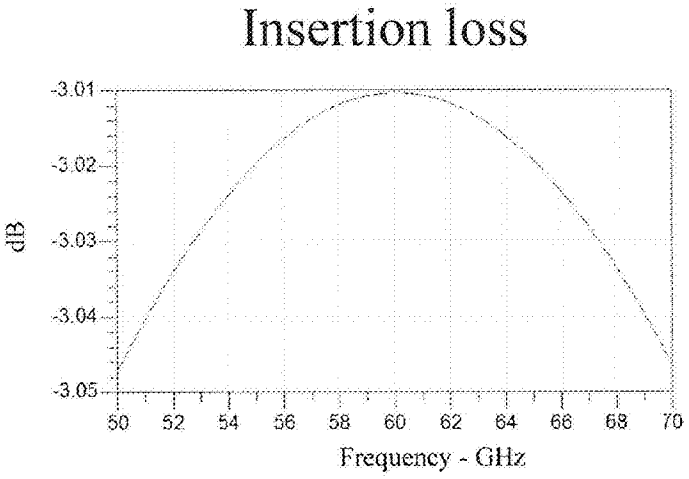
Figure 4C:
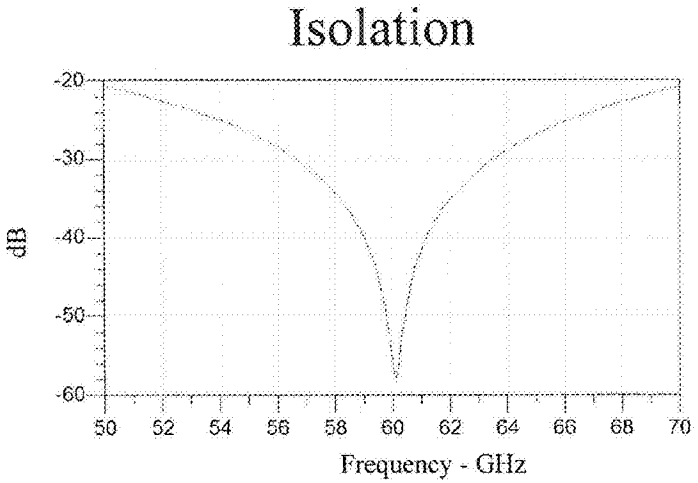

FIGS. 4A-C are graphs illustrating the simulated performance of a differential Wilkinson power divider/combiner having a mutually induced poly-loop line geometry.

Figure 5:
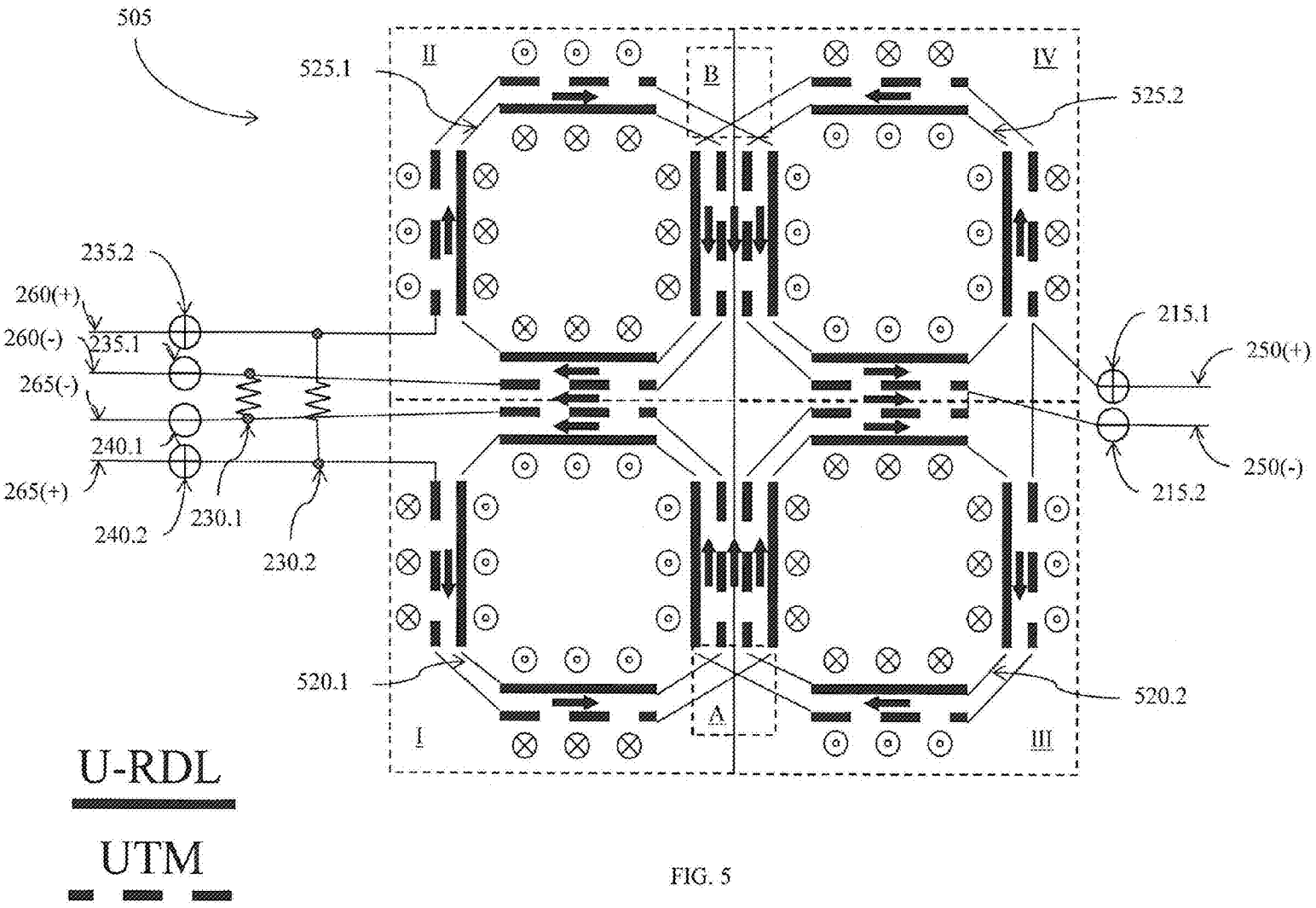

FIG. 5 illustrates a layout of a differential Wilkinson power divider/combiner.

Figure 6:
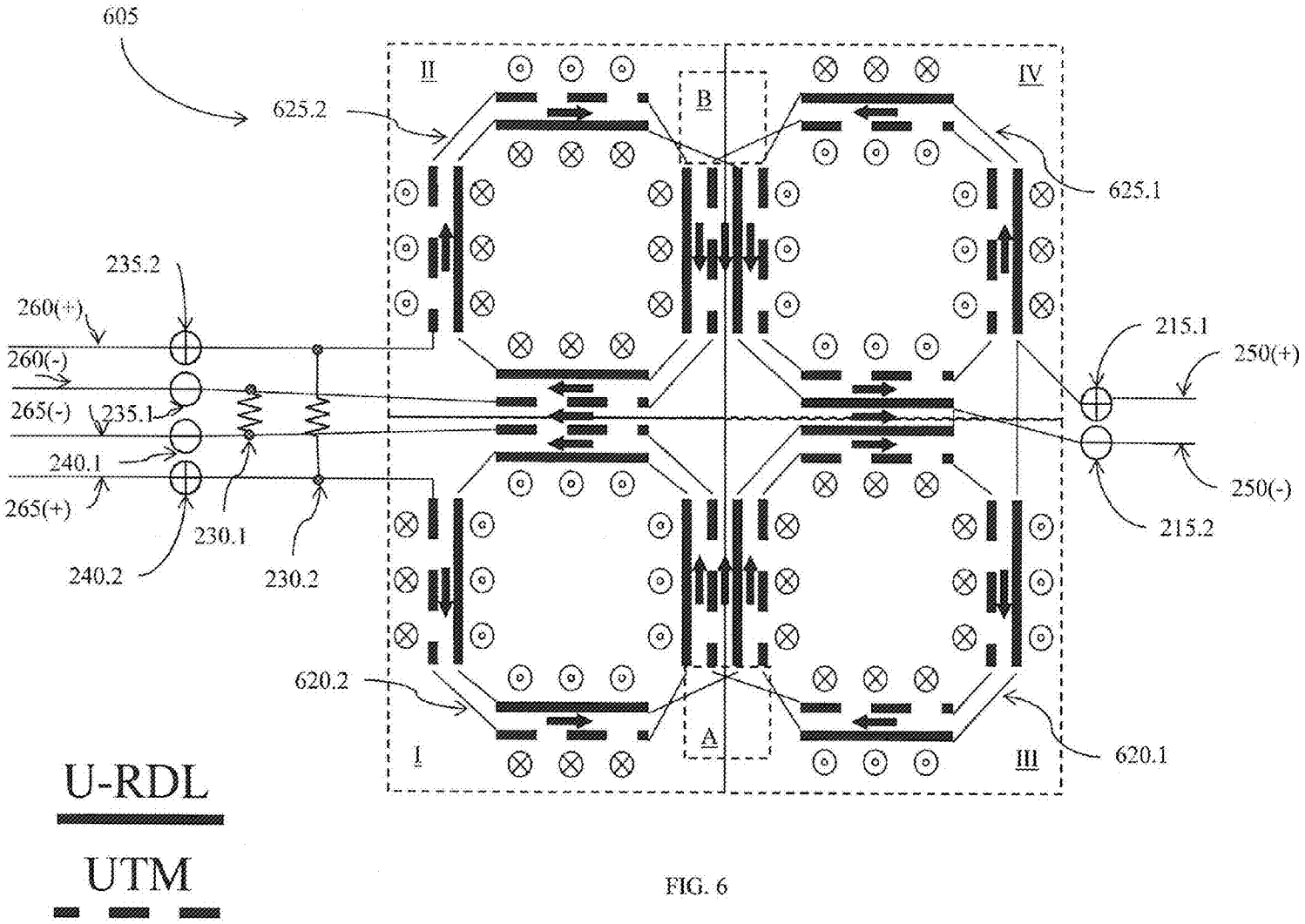

FIG. 6 illustrates an alternate layout of a differential Wilkinson power divider/combiner.

Figure 7:
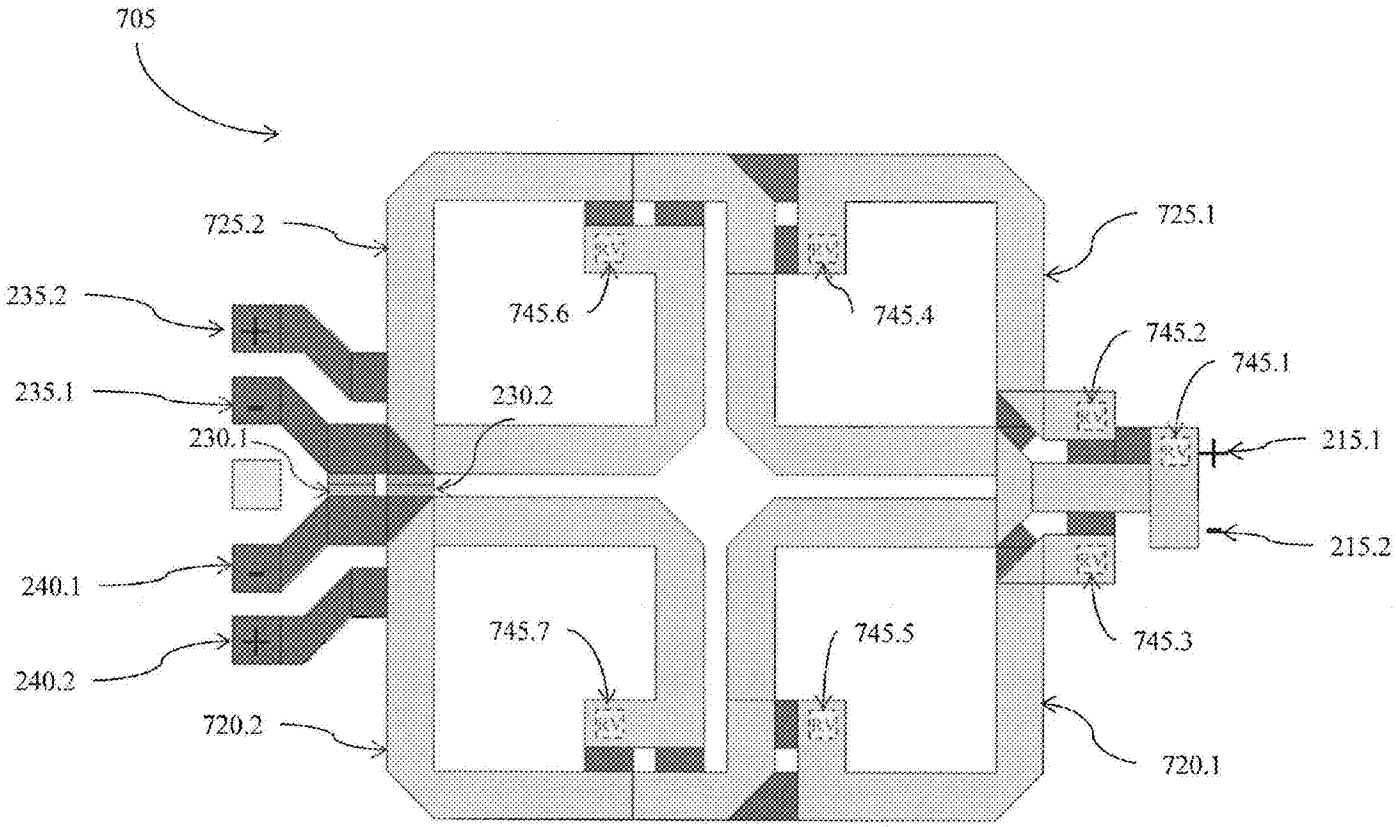

FIG. 7 illustrates a top view of a differential Wilkinson power divider/combiner.

The disclosure will now be described with reference to the accompanying drawings. In the drawings, like reference numbers generally indicate identical, functionally similar, and/or structurally similar elements. The drawing in which an element first appears is indicated by the leftmost digit(s) in the reference number.

DETAILED DESCRIPTION OF THE DISCLOSURE

The following Detailed Description refers to accompanying figures to illustrate exemplary embodiments consistent with the disclosure. References in the disclosure to "an exemplary embodiment" indicates that the exemplary embodiment described can include a particular feature, structure, or characteristic, but every exemplary embodiment can not necessarily include the particular feature, structure, or characteristic. Moreover, such phrases are not necessarily referring to the same exemplary embodiment. Further, any feature, structure, or characteristic described in connection with an exemplary embodiment can be included, independently or in any combination, with features, structures, or characteristics of other exemplary embodiments whether or not explicitly described.

The present disclosure provides for a fabrication layout and design for transmission lines that are implemented as part of a differential Wilkinson power divider/combiner. The transmission lines are configured and arranged in a poly-loop line geometry. The poly-loop line geometry includes overlapping transmission lines to route differential signals within the differential Wilkinson power divider/combiner. As a power divider, a first pair of these multiple overlapping transmission lines routes a differential signal from a pair of first ports to a positive second port and a negative third port, respectively. Additionally, a second pair of these overlapping transmission lines routes the differential signal from the pair of first ports to a positive third port and a negative second port, respectively. As a power combiner, the overlapping transmission lines routes a first differential signal received at the negative second port, the negative third port, the positive second port, and the positive third port to the pair of first ports, e.g., a positive first port and a negative first port, respectively. The overlapping transmission lines each include a crossover region to route the differential signals. As a result of the crossover, a spacing between the overlapping transmission lines is reduced such that a magnetic flux of each overlapping transmission line is combined with one another. That is, adjacent portions of the transmission lines are arranged substantially parallel to each other and carry respective currents that flow in a same direction so as to constructively contribute to a magnetic field.

FIG. 1 illustrates a conventional differential Wilkinson power divider/combiner. More specifically, FIG. 1 shows a 2-way differential Wilkinson power divider/combiner 105. Although FIG. 1 shows a 2-way differential Wilkinson power divider/combiner 105, it should be understood by those having ordinary skill in the art that the present disclosure may be implemented with any n-way Wilkinson power divider/combiner. The differential Wilkinson power divider/combiner 105 may be implemented on a lossy silicon substrate, and as such, provides better performance in signal transmitting than conventional transmission lines.

The differential Wilkinson power divider/combiner 105 includes first ports 115.1, 115.2, first transmission lines 120.1, 120.2, second transmission lines 125.1, 125.2, resistors 130.1, 130.2, second ports 135.1, 135.2, and third ports 140.1, 140.2. First ports 115.1, 115.2 provide a differential input 115, second ports 135.1, 135.2 provide a first differential output 135, and second ports 140.1, 140.2 provide a second differential output 140. The differential Wilkinson power divider/combiner 105 is a multi-port network that is ideally lossless when the input and output ports are matched to the incoming and outgoing signal lines. The differential Wilkinson power divider/combiner 105 splits an incoming differential signal received on differential input 115 into two equal phase outgoing signals that are output on differential outputs 135 and 140, or combines two equal-phase incoming signals into one outgoing signal in the opposite direction. Conventionally, the differential Wilkinson power divider/combiner 105 relies on quarter-wavelength transformers to match the second ports 135.1, 135.2 and third ports 140.1, 140.2 to the first ports 115.1, 115.2. The resistors 130.1, 130.2 respectively coupled between the second ports 135.1, 135.2 and third ports 140.1, 140.2 add no resistive loss to the power split, such that the differential Wilkinson power divider/combiner 105 is ideally 100% efficient.

As a power divider, the differential Wilkinson power divider/combiner 105 splits a first differential signal 150(+), 150(−) to provide a second differential signal 160(+), 160(−) and a third differential signal 165(+), 165(−). The second differential signal 160(+), 160(−) and a third differential signal 165(+), 165(−) are in phase with one another and have a same application, and are 180 degrees out of phase with the first differential signal 150(+), 150(−). Alternatively, as a power combiner, the differential Wilkinson power divider/combiner 105 combines the second differential signal 160(+), 160(−) and the third differential signal 165(+), 165(−) to provide the first differential signal 150(+), 150(−). The second differential signal 160(+), 160(−) and the third differential signal 165(+), 165(−) can be equal-phase input signals that are combined into the first differential signal 150(+), 150(−) as an output in the opposite direction. The first differential signal 150(+), 150(−) is 180 degrees out of phase with the second differential signal 160(+), 160(−) and the third differential signal 165(+), 165(−).

High isolation between the second ports 135.1, 135.2 and the third ports 140.1, 140.1 can be obtained for the differential Wilkinson power divider/combiner 105 using quarter-wavelength transformers having a characteristic impedance of $\sqrt{2}$*Zo and a lumped isolation resistor of 2Zo, with all the ports, e.g., the first ports 115.1, 115.2, the second ports 135.1. 135.2, and the third ports 140.1, 140.2, having a matched impedance, Zo. Thus, the Wilkinson power divider/combiner 105 relies on the quarter-wavelength transformers, e.g., the first transmission lines 120.1, 120.2 and the second transmission lines 125.1, 125.2, to match the second ports 135.1, 135.2 and the third ports 140.1, 140.2 to the first ports 115.1, 115.2, and vice-versa. The first transmission lines 120.1, 120.2 and the second transmission lines 125.1, 125.2 have an electrical length of a quarter-wavelength at one specific frequency, which amounts to a narrow-band matching technique. In the Wilkinson power divider/combiner 105, the second differential signal 160(+), 160(−) and the third differential signal 165(+), 165(−) (when operating as a splitter) or the first differential signal 150(+), 150(−) (when operating as a combiner) are/is 3 dB below the amplitude of the input signal(s), and they are/is also in phase with each other. Additionally, the second differential signal 160(+), 160(−) and the third differential signal 165(+), 165(−) are mutually isolated.

The first ports 115.1, 115.2 have a characteristic impedance Zo and are coupled to the first transmission lines 120.1, 120.2 and the second transmission lines 125.1, 125.2, respectively. The first transmission lines 120.1, 120.2 and the second transmission lines 125.1, 125.2 comprise quarter-wave impedance transformers. The first transmission lines 120.1, 120.2 and the second transmission lines 125.1, 125.2 have a characteristic impedance of $\sqrt{2}$*Zo, such that the first differential signals 150(+), 150(−) are matched when the second differential signals 160(+), 160(−) and the differential third signals 165(+), 165(−) are terminated in Zo at their respective differential ports 135 and 140.

Conventionally, the first transmission lines 120.1, 120.2 and the second transmission lines 125.1, 125.2 represent transmission lines coupling the first ports 115.1, 115.2 to the second ports 135.1, 135.2, and the third ports 140.1, 140.2, respectively. These conventional transmission lines have an electrical quarter wavelength. To achieve this, the first transmission lines 120.1, 120.2 and the second transmission lines 125.1, 125.2 can be configured with lumped elements to reduce the length of the first transmission lines 120.1, 120.2 and the second transmission lines 125.1, 125.2. For example, the first transmission lines 120.1, 120.2 and the second transmission lines 125.1, 125.2 can include capacitive and/or inductive elements that can be configured as LC equivalent circuits, e.g., a "pi" LC equivalent circuit or a "tee" LC equivalent circuit, as would be understood by a person of ordinary skill in the relevant arts.

The resistor 130.1 is connected between the second port 135.1 and the third port 140.1. Likewise the resistor 130.2 is connected between the second port 135.2 and the third port 140.2. The second ports 135.1, 135.2 and the third ports 140.1, 140.2 are at approximately equal potential, and as such, no current flows across the resistors 130.1, 130.2, thereby decoupling the resistors 130.1, 130.2 from the first differential signals 150(+), 150(−).

Figure 2:
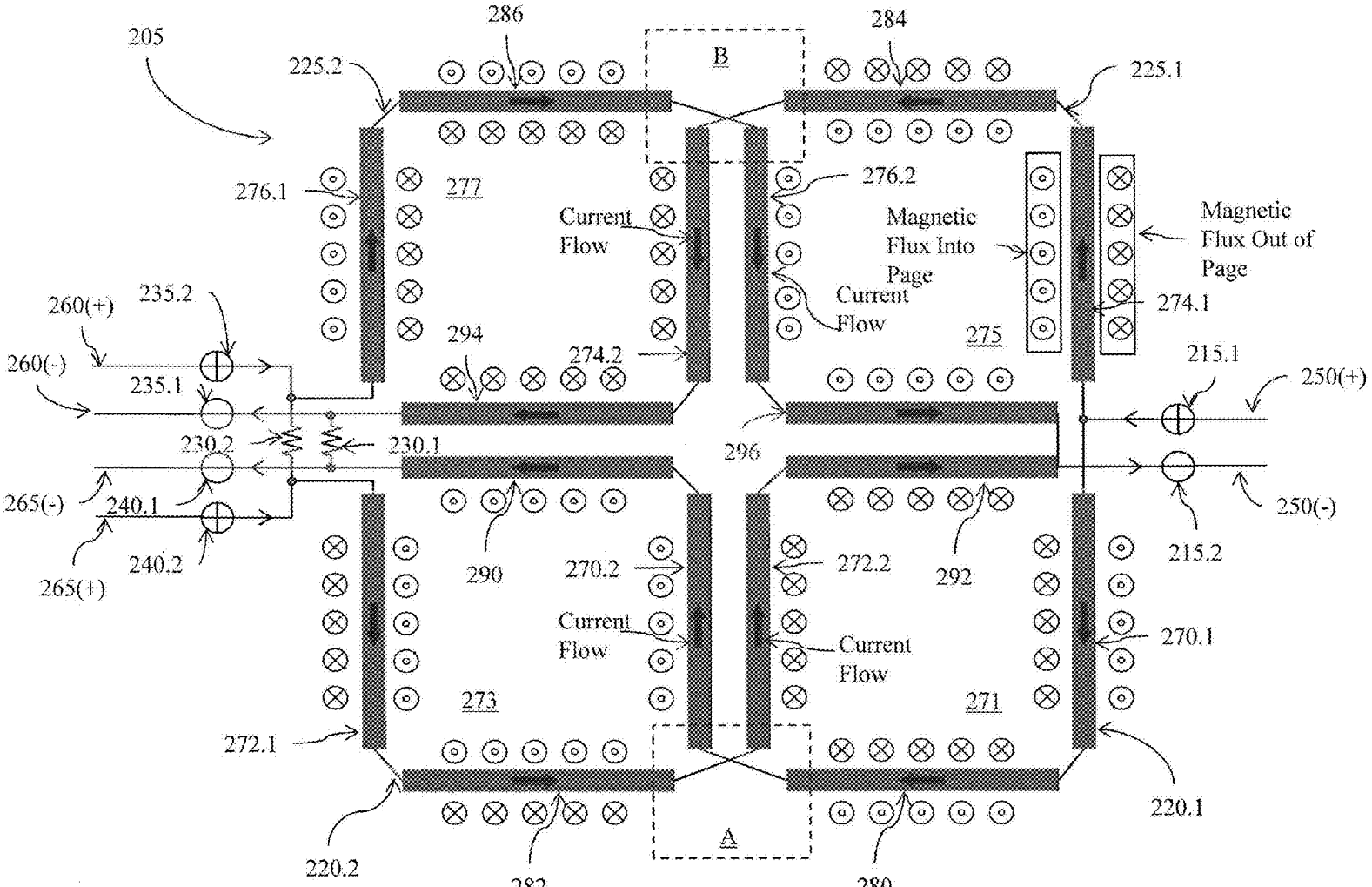
FIG. 2 illustrates a layout of a differential Wilkinson power divider/combiner.

FIG. 2 illustrates a layout of a differential Wilkinson power divider/combiner 205 according to embodiments of the disclosure. More specifically, FIG. 2 shows a 2-way differential Wilkinson power divider/combiner 105. Although FIG. 2 shows a 2-way differential Wilkinson power divider/combiner 205, it should be understood by those having ordinary skill in the art that the present disclosure may be implemented with any n-way Wilkinson power divider/combiner. The differential Wilkinson power divider/combiner 205 may be implemented on a lossy silicon substrate, and as such, provides better performance in signal transmitting than conventional transmission lines.

The differential Wilkinson power divider/combiner 205 includes first ports 215.1, 215.2, first transmission lines 220.1, 220.2, second transmission lines 225.1, 225.2, resistors 230.1, 230.2, second ports 235.1, 235.2, and third ports 240.1, 240.2. First ports 215.1, 215.2 provide a differential input 215, second ports 235.1, 235.2 provide a first differential output 235, and second ports 240.1, 240.2 provide a second differential output 240. The differential Wilkinson power divider/combiner 205 is a multi-port network that is ideally lossless when the input and output ports are matched to the incoming and outgoing signal lines. The differential Wilkinson power divider/combiner 205 splits an incoming differential signal received on differential input 215 into two equal phase outgoing signals that are output on differential outputs 235 and 240, or combines two equal-phase incoming signals into one outgoing signal in the opposite direction. The resistors 230.1, 230.2 respectively coupled between the second ports 235.1, 235.2 and third ports 240.1, 240.2 ideally add no resistive loss to the power split, such that the differential Wilkinson power divider/combiner 205 is ideally 100% efficient.

As a power divider, the differential Wilkinson power divider/combiner 205 splits a first differential signal 250(+), 250(−) to provide a second differential signal 260(+), 260(−) and a third differential signal 265(+), 265(−). The second differential signal 260(+), 260(−) and a third differential signal 265(+), 265(−) are in phase with one another and have a same application, and are 180 degrees out of phase with the first differential signal 250(+), 250(−). Alternatively, as a power combiner, the differential Wilkinson power divider/combiner 205 combines the second differential signal 260(+), 260(−) and the third differential signal 265(+), 265(−) to provide the first differential signal 250(+), 250(−). The second differential signal 260(+), 260(−) and the third differential signal 265(+), 265(−) can be equal-phase input signals that are combined into the first differential signal 250(+), 250(−) as an output in the opposite direction. The first differential signal 250(+), 250(−) is 180 degrees out of phase with the second differential signal 260(+), 260(−) and the third differential signal 265(+), 265(−).

High isolation between the second ports 235.1, 235.2 and the third ports 240.1, 240.1 is be obtained for the differential Wilkinson power divider/combiner 205 using quarter-wavelength transformers having a characteristic impedance of $\sqrt{2}$*Zo and a lumped isolation resistor of 2Zo, with all the ports, e.g., the first ports 215.1, 215.2, the second ports 235.1. 235.2, and the third ports 240.1, 240.2, having a matched impedance, Zo. Thus, the Wilkinson power divider/combiner 205 relies on the quarter-wavelength transformers, e.g., the first transmission lines 220.1, 220.2 and the second transmission lines 225.1, 225.2, to match the second ports 235.1, 235.2 and the third ports 240.1, 240.2 to the first ports 215.1, 215.2, and vice-versa. The first transmission lines 220.1, 220.2 and the second transmission lines 225.1, 225.2 have an electrical length of a quarter-wavelength at one specific frequency, which amounts to a narrow-band matching technique. In the Wilkinson power divider/combiner 205, the second differential signal 260(+), 260(−) and the third differential signal 265(+), 265(−) (when operating as a splitter) or the first differential signal 250(+), 250(−) (when operating as a combiner) are/is 3 dB below the amplitude of the input signal(s), and they are/is also in phase with each other. Additionally, the second differential signal 260(+), 260(−) and the third differential signal 265(+), 265(−) are mutually isolated.

The first ports 215.1, 215.2 have a characteristic impedance Zo and are coupled to the first transmission lines 220.1, 220.2 and the second transmission lines 225.1, 225.2, respectively. The first transmission lines 220.1, 220.2 and the second transmission lines 225.1, 225.2 comprise quarter-wave impedance transformers. The first transmission lines 220.1, 220.2 and the second transmission lines 225.1, 225.2 have a characteristic impedance of $\sqrt{2}$*Zo, such that the first differential signals 250(+), 250(−) are matched when the second differential signals 260(+), 260(−) and the differential third signals 265(+), 265(−) are terminated in Zo at their respective differential ports 235 and 240.

The first transmission lines 220.1, 220.2 and the second transmission lines 225.1, 225.2 have the electrical characteristics of a quarter-wave impedance transformers at a predetermined frequency of interest. The first transmission lines 220.1, 220.2 are arranged in a mutually induced poly-loop line geometry to increase mutual coupling and mutual inductance between the first transmission lines 220.1, 220.2. Likewise, the second transmission lines 225.1, 225.2 are arranged in a mutually induced poly-loop line geometry to increase mutual coupling and mutual inductance between the second transmission lines 225.1, 225.2.

In the mutually induced poly-loop line geometry, the first transmission line 220.1 forms a first open loop 271 that extends from a differential input port, e.g., first port 215.1, to a first differential output port, e.g., third port 240.1. In forming open loop 271, the first transmission line 220.1 includes vertical portions 270.1, 270.2 that are parallel to one another, horizontal portion 280 that is orthogonal to the vertical portions 270.1, 270.2, and a remnant portion 290 that connects to third port 240.1. Likewise, the first transmission line 220.2 forms a second open loop 273 from a differential input component, e.g., first port 215.2, to a second differential output port, e.g., third port 240.2. In forming open loop 273, the first transmission line 220.2 includes vertical portions 272.1, 272.2 that are parallel to one another, horizontal portion 282 that is orthogonal to the vertical portions 272.1, 272.2, and a remnant portion 292 that is connected to first port 215.2.

Additionally, in the mutually induced poly-loop line geometry, the second transmission lines 225.1, 225.2 are arranged in the similar fashion as first transmission lines 220.1, 220.2. For example, the second transmission line 225.1 forms a first open loop 275 from a differential input component, e.g., first port 215.1, to a third differential output port, e.g., second port 235.1. In forming open loop 275, the second transmission line 225.1 includes vertical portions 274.1, 274.2 that are parallel to each other, horizontal portion 284 that is orthogonal to the vertical portions 274.1, 274.2, and a remnant portion 294. Likewise, the second transmission line 225.2 forms a second open loop 277 from a differential input component, e.g., first port 215.2, to a fourth differential output port, e.g., third port 235.2. In forming open loop 277, the second transmission lines 225.2 includes vertical portions 276.1, 276.2 that are parallel to one another, horizontal portion 286 that is orthogonal to the vertical portions 276.1, 276.2, and a remnant portion 296 that is connected to first port 215.2.

The first transmission lines 220.1, 220.2 crossover one another and the second transmission lines 225.1, 225.2 crossover one another. For example, as illustrated in FIG. 2, the first transmission lines 220.1, 220.2 overlap in crossover region A and the second transmission lines 225.1, 225.2 overlap in crossover region B. Additionally, as a result of the mutually induced poly-loop line geometry, neighboring transmission lines, e.g., first transmission lines 220.1, 220.2 (or second transmission lines 225.1, 225.2) have respective currents flowing in a same direction, which increases the magnetic flux caused by the first transmission lines 220.1, 220.2 (or the second transmission lines 225.1, 225.2). For example, vertical portion 270.2 of transmission line 220.1 is arranged substantially parallel to vertical portion 272.2 of transmission line 220.2, and so their current flow in substantially the same direction. Transmission lines 225.1 and 225.2 overlap in a similar manner in crossover region B, and corresponding portions 274.2, 276.2 that are arranged in parallel and have currents that flow in a same direction as shown.

As result of the overlapping transmission lines, the magnetic flux of the first transmission lines 220.1, 220.2 is increased thereby increasing the mutual coupling and the mutual inductance between first transmission lines 220.1, 220.2. Similarly, the magnetic flux of the second transmission lines 225.1, 225.2 is increased thereby increasing the mutual coupling and the mutual inductance between the second transmission lines 225.1, 225.2. As a result of this increased mutual coupling and mutual inductance, the first transmission lines 220.1, 220.2 and the second transmission lines 225.1, 225.2 are advantageously shorter than conventional transmission lines, e.g., the first transmission lines 120.1, 120.2 and the second transmission lines 125.1, 125.2 illustrated in FIG. 1. Accordingly, the a differential Wilkinson power divider/combiner 205 can have a reduced footprint relative to conventional power dividers. For example, in an embodiment, the differential Wilkinson power divider/combiner 205 can have an overall size of 70 microns when operated at a center frequency of 60 GHz, whereas a conventional Wilkinson power divider/combiner has an overall size of 700-800 microns for 60 GHz applications.

Figure 3A:
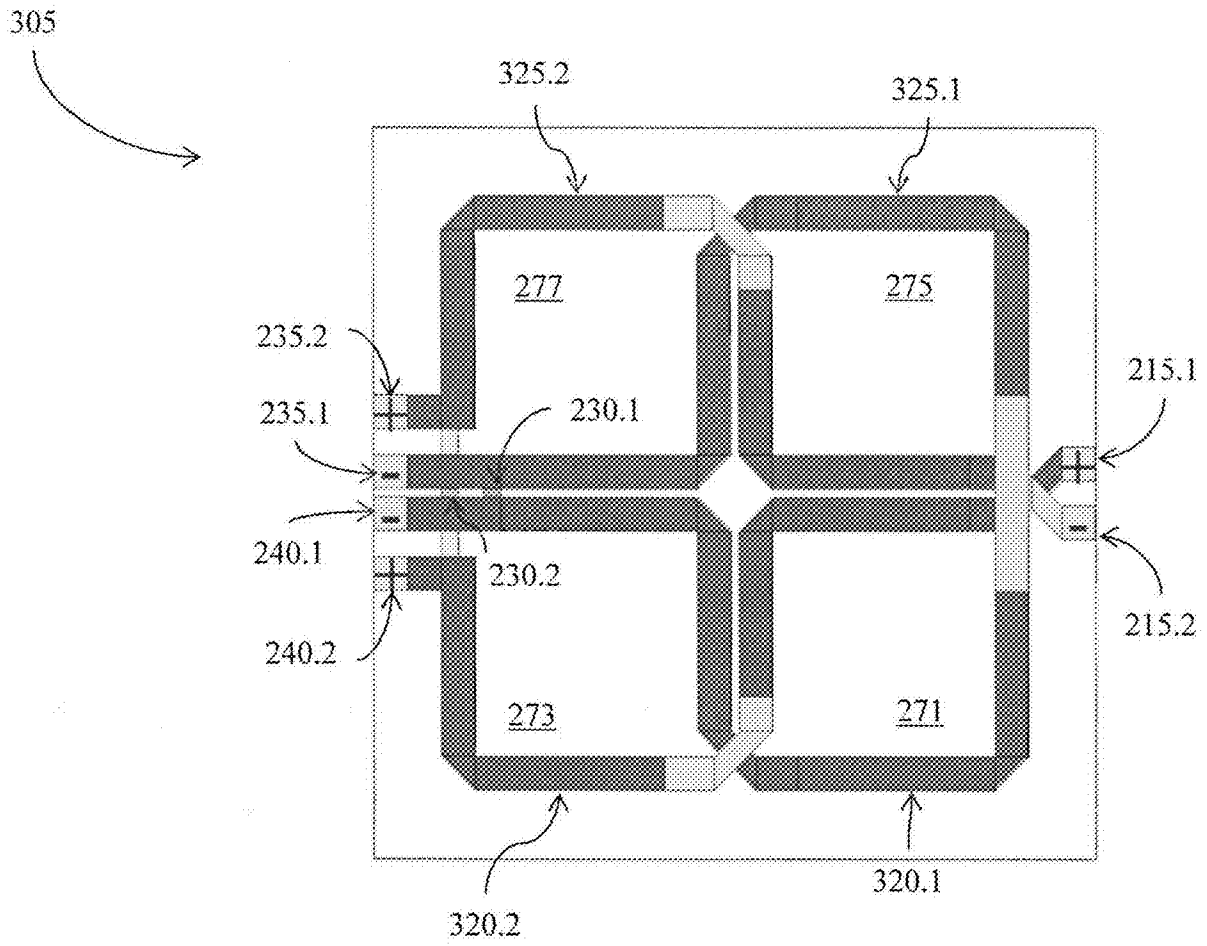
FIG. 3A illustrates a top view of a differential Wilkinson power divider/combiner.

FIG. 3A illustrates a top view of a differential Wilkinson power divider/combiner 305. FIG. 3A illustrates a layout of the differential Wilkinson power divider/combiner 305 according to an exemplary embodiment of the present disclosure, e.g., the differential Wilkinson power divider/combiner 205. The differential Wilkinson power divider/combiner 305 shares similar features to the differential Wilkinson power divider/combiner 205 as described in FIG. 2. The differential Wilkinson power divider/combiner 305 includes first transmission lines 320.1, 320.2 and second transmission lines 325.1, 325.2. As illustrated in FIG. 3A, portions of the first transmission lines 320.1, 320.2 overlap with one another. Likewise, portions of the second transmission lines 325.1, 325.2 overlap with one another. As a result of the overlap between the first transmission lines 320.1, 320.2 and the second transmission lines 325.1, 325.2, respectively, neighboring transmission lines, e.g., first transmission lines 320.1, 320.2 (or the second transmission lines 325.1, 325.2) have respective currents flowing in a same direction, which causes mutual coupling thereby increasing the inductance between the first transmission lines 320.1, 320.2 (or the second transmission lines 325.1, 325.2).

Additionally, a distance between the first transmission lines 320.1, 320.2 and a distance between the second transmission lines 325.1, 325.2 is arranged to further increase the inductance between the first transmission lines 320.1, 320.1 and between the second transmission lines 325.1, 325.2, respectively. For example, a distance between the first transmission lines 320.1, 320.2 and a distance between the second transmission lines 325.1, 325.2 can be 1 μm. As a result of the increased mutual coupling and inductance, the respective lengths of the first transmission lines 320.1, 320.2 and the second transmission lines 325.1, 325.2 can be reduced, which reduces the overall size of the differential Wilkinson power divider/combiner 305. Additionally, the respective widths of the first transmission lines 320.1, 320.2 and the second transmission lines 325.1, 325.2 can be 4 μm. The respective widths of the first transmission lines 320.1, 320.2 and the second transmission lines 325.1, 325.2 further increases the mutual inductance between the first transmission lines 320.1, 320.2 and the second transmission lines 325.1, 325.2, respectively.

Figure 3B:
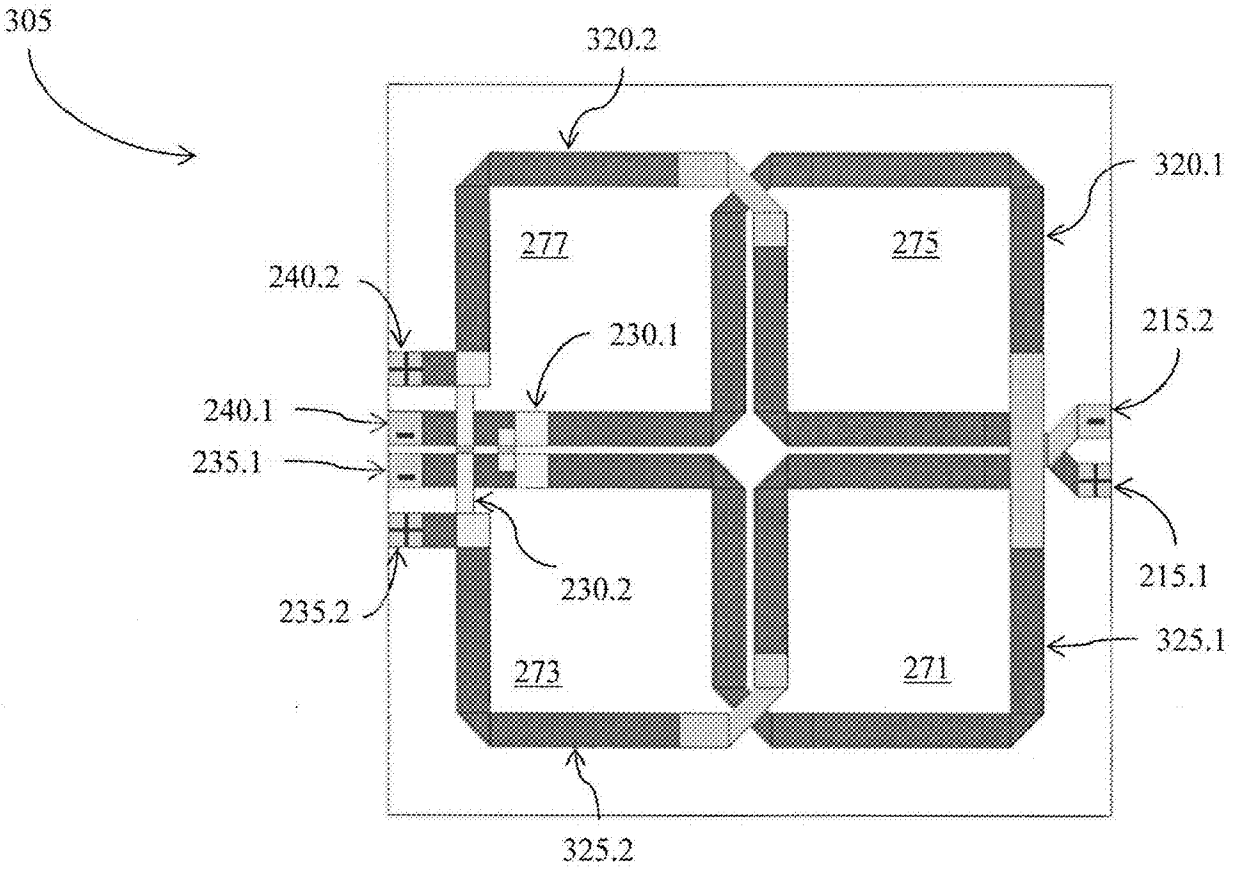
FIG. 3B illustrates a bottom view of a differential Wilkinson power divider/combiner.

FIG. 3B illustrates a bottom view of the differential Wilkinson power divider/combiner 305. FIG. 3B illustrates a layout of the differential Wilkinson power divider/combiner 305 according to an exemplary embodiment of the present disclosure, e.g., the differential Wilkinson power divider/combiner 205. As illustrated in FIG. 3B, the differential Wilkinson power divider/combiner 305 comprises resistors 230.1, 230.2. The resistor 230.1 is connected between the second port 235.1 and third port 240.1. Similarly, the resistor 230.2 is connected between the second port 235.2 and the third port 240.2.

Figure 3C:
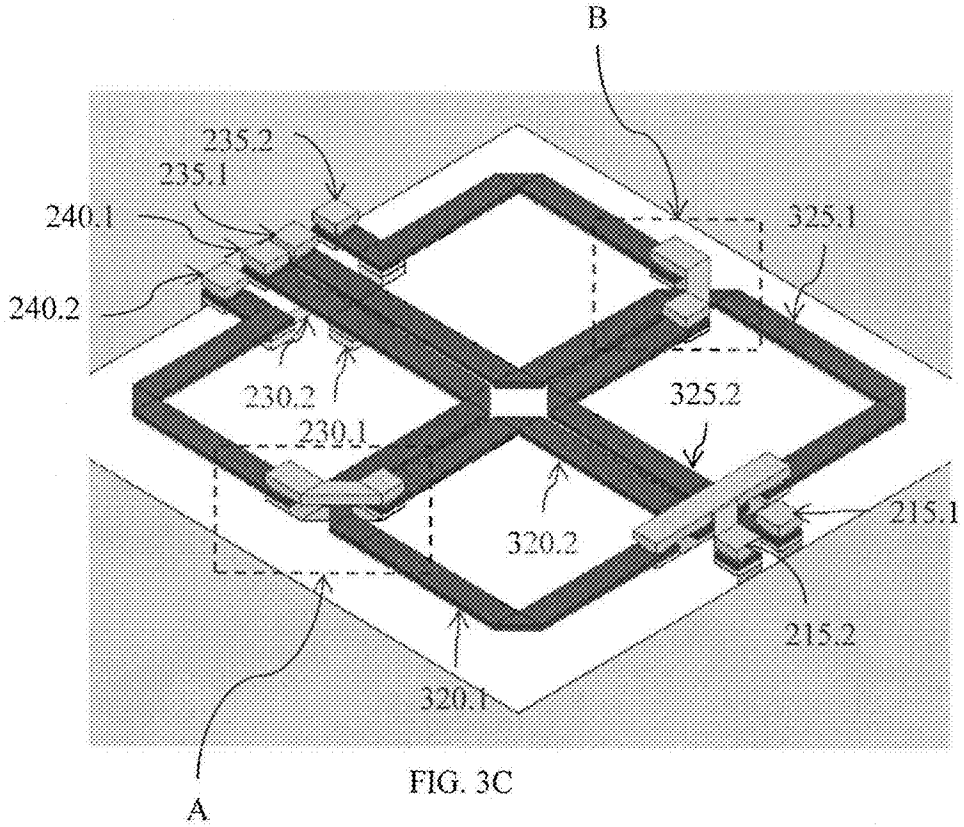
FIG. 3C illustrates a top view of an isometric view the differential Wilkinson power divider/combiner shown in FIG. 3A.
Figure 3D:
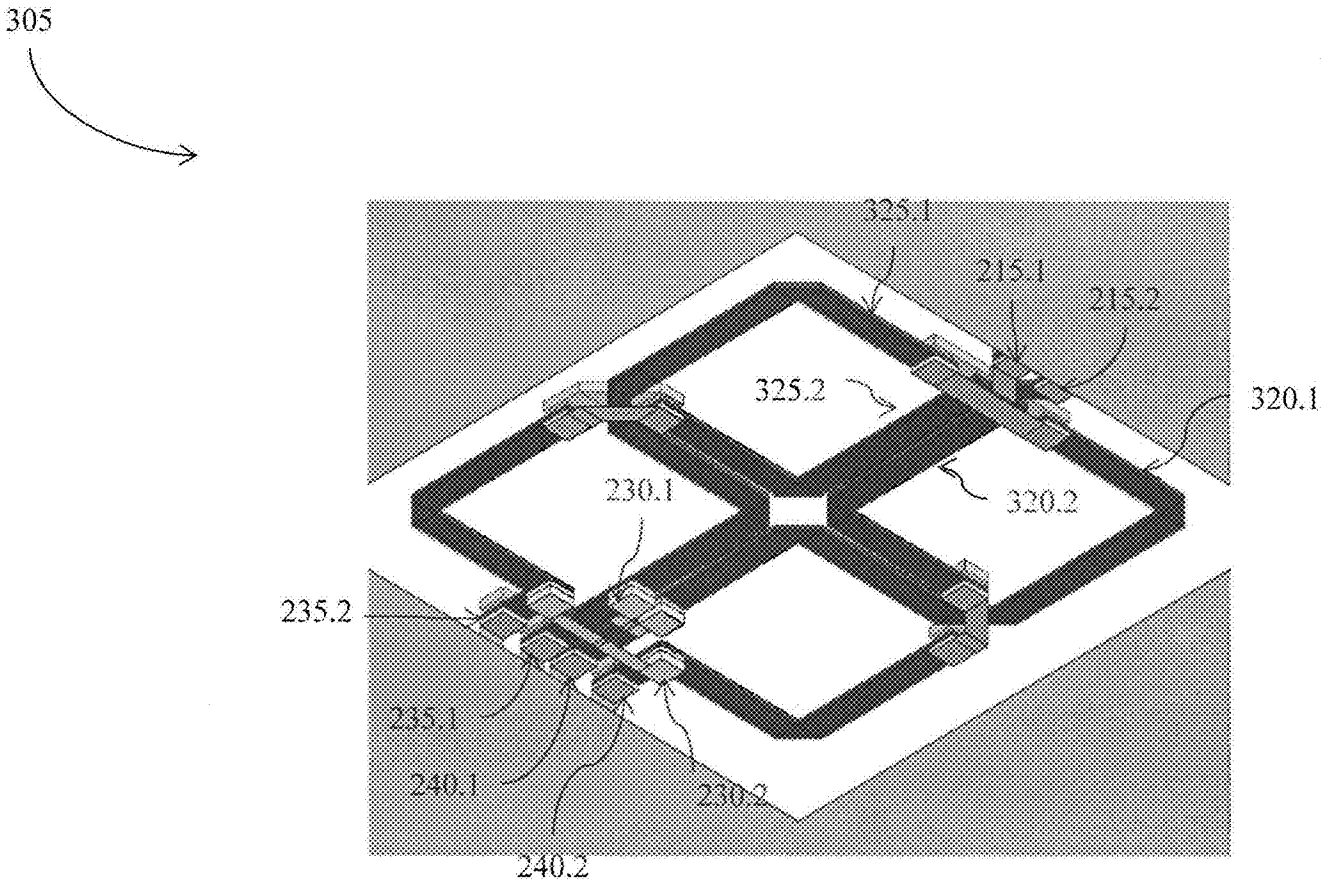
FIG. 3D illustrates a bottom view of an isometric view the differential Wilkinson power divider/combiner shown in FIG. 3B.

FIG. 3C illustrates a top view of an isometric view the differential Wilkinson power divider/combiner 305 shown in FIG. 3A. As illustrated in FIG. 3C, the first transmission lines 320.1, 320.2 overlap in crossover region A and the second transmission lines 325.1, 325.2 overlap in crossover region B. FIG. 3D illustrates a bottom view of an isometric view the differential Wilkinson power divider/combiner 305 shown in FIG. 3B.

FIGS. 4A-C are graphs illustrating the simulated performance of a differential Wilkinson power divider/combiner having a mutually induced poly-loop line geometry. For example, the differential Wilkinson power divider/combiner, e.g., the differential Wilkinson power divider/combiner 205 of FIG. 2, has a return loss of −60 dB at 60 GHz, as shown in FIG. 4A, an insertion loss of −3.01 dB at 60 GHz, as shown in FIG. 4B, and isolation of about −60 dB at 60 GHz, as shown in FIG. 4C. A person of ordinary skill in the relevant arts would understand that the differential Wilkinson power divider/combiner as described herein thus provides the requisite electrical performance characteristics of a Wilkinson power divider/combiner.

FIG. 5 illustrates a layout of a differential Wilkinson power divider/combiner 505 according to an exemplary embodiment of the present disclosure, e.g., the differential Wilkinson power divider/combiner 205. The differential Wilkinson power divider/combiner 505 shares many substantially similar features to the differential Wilkinson power divider/combiner 205 as described in FIG. 2; therefore, only differences between the differential Wilkinson power divider/combiner 505 and the differential Wilkinson power divider/combiner 205 are to be discussed in further detail.

In the differential Wilkinson power divider/combiner 505, the first transmission lines 520.1, 520.2 and the second transmission lines 525.1, 525.2 are arranged in a mutually induced poly-loop line geometry to increase mutual coupling and mutual inductance between the first transmission lines 520.1, 520.2 as well as increase mutual coupling and mutual inductance between the second transmission lines 525.1, 525.2. In the mutually induced poly-loop line geometry, the first transmission lines 520.1, 520.2 crossover one another and the second transmission lines 525.1, 525.2 crossover one another. Additionally, in the poly-loop line geometry, the first transmission lines 520.1, 520.2 each comprise a plurality of metal layers. In embodiments, the plurality of metal layers of the first transmission lines 520.1, 520.2 are formed over each other. Similarly, the second transmission lines 525.1, 525.2 each comprise a plurality of metal layers. In embodiments, the plurality of layers of the second transmission lines 525.1, 525.2 are formed over each other. As illustrated in FIG. 5, the first transmission line 520.1 may be formed using the plurality of layers in region I. In embodiments, a first layer of the transmission line 520.1 may be formed using an under redistribution layer ("U-RDL") and a second layer of the transmission line can be formed using an ultra-thick metal layer ("UTM") that is disposed over and in contact with the U-RDL layer. The first transmission line 520.2 and the second transmission lines 525.1, 525.2 may likewise comprise two metal layer windings laid over one another. For example, the second transmission line 525.1 may be formed using the U-RDL and the UTM in region II, the first transmission line 520.2 may be formed using the U-RDL and the UTM in region III, and the second transmission line 525.2 may be formed using the U-RDL and the UTM in region IV.

By utilizing a plurality of layers, the first transmission lines 520.1, 520.2 and the second transmission lines 525.1, 525.2 have a greater thickness than that achieved with a single metal layer so as to further intensify the magnetic field, and therefore the transmission lines can be shorter than the transmission lines of a differential Wilkinson power divider/combiner, e.g., the differential Wilkinson power divider/combiner 205 of FIG. 2. That is, the plurality of metal layers provide greater mutual coupling and mutual inductance, and therefore the first transmission lines 520.1, 520.2 and the second transmission lines 525.1, 525.2 can be made shorter while maintaining the electrical quarter wavelength characteristics required for a Wilkinson power divider/combiner.

As further illustrated in FIG. 5, the first transmission lines 520.1, 520.2 and the second transmission lines 525.1, 525.2 are formed in mutually induced poly-loop line geometry, whereby neighboring transmission lines have respective currents flowing in a same direction. The mutually induced poly-loop line geometry increases the magnetic flux of caused by the first transmission lines 520.1, 520.2 and the second transmission lines 525.1, 525.2. As result of the overlapping transmission lines, the magnetic flux of the first transmission lines 520.1, 520.2 and the magnetic flux of the second transmission lines 525.1, 525.2 is increased thereby increasing the mutual coupling and the mutual inductance between first transmission lines 520.1, 520.2 and between the second transmission lines 525.1, 525.2.

Additionally, the mutually induced poly-loop line geometry reduces the size of the first transmission lines 520.1, 520.2 and the second transmission lines 525.1, 525.2. That is, with this mutual coupling and mutual inductance, the length of the first transmission lines 520.1, 520.2 and the second transmission lines 525.1, 525.2 can be reduced, which results in an overall size reduction of the differential Wilkinson power divider/combiner 505. For example, in an embodiment, the differential Wilkinson power divider/combiner 505 can have an overall size of 50 microns.

FIG. 6 illustrates an alternate layout of a differential Wilkinson power divider/combiner 605 according to an exemplary embodiment of the present disclosure, e.g., the differential Wilkinson power divider/combiner 205. The differential Wilkinson power divider/combiner 605 shares many substantially similar features to the differential Wilkinson power divider/combiner 505 as described in FIG. 5; however, differences between the differential Wilkinson power divider/combiner 605 and the differential Wilkinson power divider/combiner 505 are discussed in detail.

As illustrated in FIG. 6, the first transmission line 620.1 may be formed using a plurality of layers in region III. For example, in embodiments, the first transmission line 620.1 comprises two metal layer windings, e.g., the U-RDL and the UTM, laid over one another. The first transmission line 620.2 and the second transmission lines 625.1, 625.2 may likewise comprise two metal layer windings laid over one another. Thus, the second transmission line 625.1 may be formed using the plurality of layers in region IV, the first transmission line 620.2 may be formed using the plurality of layers in region I, and the second transmission line 625.2 may be formed using the plurality of layers in region II.

FIG. 7 illustrates a top view of a differential Wilkinson power divider/combiner 705. The differential Wilkinson power divider/combiner 705 shares similar features to the differential Wilkinson power divider/combiner 505 as described in FIG. 5; however, differences between the differential Wilkinson power divider/combiner 705 and the differential Wilkinson power divider/combiner 505 are discussed in detail. The differential Wilkinson power divider/combiner 705 first transmission lines 720.1, 720.2, second transmission lines 725.1, 725.2, and a plurality of redistribution vias 745.1 through 745.7. In embodiments, portions of the first transmission lines 720.1, 720.2 overlap with one another. Likewise portions of the second transmission lines 725.1, 725.2 overlap with one another. The overlap between the first transmission lines 720.1, 720.2 increases mutual coupling between neighboring transmission lines by increasing the inductance between the first transmission lines 720.1, 720.2. Similarly, the overlap between the and the second transmission lines 725.1, 725.2 increases mutual coupling between neighboring transmission lines by increasing the inductance between the second transmission lines 725.1, 725.2. The redistribution vias 745.4 through 745.7 are configured to respectively couple the layers of the first transmissions lines 720.1, 720.2 to one another and the layers of the second transmission lines 725.1, 725.2 to one another. Additionally, the redistribution vias 745.1 through 745.3 are configured to couple to the first transmission lines 720.1, 720.2 and the second the second transmission lines 725.1, 725.2 to the first ports 715.1, 715.2, respectively.

Additionally, a distance between the first transmission line 720.1 and the second transmission line 725.1 further increases the inductance between the first transmission line 720.1 and the second transmission line 725.1. For example, a distance between the first transmission lines 720.1, 720.2 and a distance between the second transmission lines 725.1, 725.2 can be 1.8 μm. As a result of the increased mutual coupling and inductance, the length of the first transmission lines 720.1, 720.2 and the second transmission lines 725.1, 725.2 can be reduced, which reduces the overall size of the differential Wilkinson power divider/combiner 705. Additionally, a width of the first transmission lines 720.1, 720.2 and the second transmission lines 725.1, 725.2 can be increased to further increase the mutual coupling and the mutual inductance. For example, in embodiments, the width of the first transmission lines 720.1, 720.2 and the second transmission lines 725.1, 725.2 can be 3.8 μm. The width of the first transmission lines 720.1, 720.2 and the second transmission lines 725.1, 725.2 further increases the mutual inductance between the first transmission lines 720.1, 720.2 and the second transmission lines 725.1, 725.2, respectively.

CONCLUSION

The exemplary embodiments described within the disclosure have been provided for illustrative purposes, and are not intend to be limiting. Other exemplary embodiments are possible, and modifications can be made to the exemplary embodiments while remaining within the spirit and scope of the disclosure. The disclosure has been described with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

For purposes of this discussion, the term "module" shall be understood to include at least one of software, firmware, and hardware (such as one or more circuits, microchips, or devices, or any combination thereof), and any combination thereof. In addition, it will be understood that each module can include one, or more than one, component within an actual device, and each component that forms a part of the described module can function either cooperatively or independently of any other component forming a part of the module. Conversely, multiple modules described herein can represent a single component within an actual device. Further, components within a module can be in a single device or distributed among multiple devices in a wired or wireless manner.

The Detailed Description of the exemplary embodiments fully revealed the general nature of the disclosure that others can, by applying knowledge of those skilled in relevant art(s), readily modify and/or adapt for various applications such exemplary embodiments, without undue experimentation, without departing from the spirit and scope of the disclosure. Therefore, such adaptations and modifications are intended to be within the meaning and plurality of equivalents of the exemplary embodiments based upon the teaching and guidance presented herein. It is to be understood that the phraseology or terminology herein is for the purpose of description and not of limitation, such that the terminology or phraseology of the present specification is to be interpreted by those skilled in relevant art(s) in light of the teachings herein.

What is claimed is:

1. A differential power divider/combiner, comprising:

a first pair of transmission lines coupled between a differential input and a first differential output, wherein a first transmission line and a second transmission line of the first pair of transmission lines are disposed to form respective first and second open loops that are adjacent to one another between the differential input and the first differential output, and cross over one another in a first crossover region;

a second pair of transmission lines coupled between the differential input and a second differential output, wherein a third transmission line and a fourth transmission line of the second pair of transmission lines are disposed to form respective third and fourth open loops that are adjacent to one another between the differential input and the second differential output, and cross over one another in a second crossover region;

a first resistor coupled between the first transmission line and the third transmission line; and a second resistor coupled between the second transmission line and the fourth transmission line.

2. The differential power divider/combiner of claim 1, wherein the adjacent portions of the first open loop and the second open loop are arranged substantially parallel to each other and carry respective currents that flow in a same direction so as to constructively contribute to a magnetic field.

3. The differential power divider/combiner of claim 1, wherein the adjacent portions of the third open loop and the fourth open loop are arranged substantially parallel to each other and carry respective currents that flow in a same direction so as to constructively contribute to a magnetic field.

4. The differential power divider/combiner of claim 1, wherein the first open loop and the second open loop include at least one vertical portion and at least one horizontal portion that is orthogonal to the at least one vertical portion.

5. The differential power divider/combiner of claim 1, wherein the third open loop and the fourth open loop include at least one vertical portion and at least one horizontal portion that is orthogonal to the at least one vertical portion.

6. The differential power divider/combiner of claim 1, wherein the first transmission line and the second transmission line provide respective first and second quarter wave transformers between the differential input and the first differential output.

7. The differential power divider/combiner of claim 1, wherein the third transmission line and the fourth transmission line provide respective first and second quarter wave transformers between the differential input and the second differential output.

8. The differential power divider/combiner of claim 1, wherein the first pair of transmission lines and the second pair of transmission lines each comprise a plurality of metal layers.

9. The differential power divider/combiner of claim 8, wherein the plurality of metal layers comprises two metal layer windings laid over one another.

10. The differential power divider/combiner of claim 9, wherein a first layer of the metal layer windings comprises an under redistribution layer ("U-RDL") and a second layer of the metal layer windings comprises an ultra-thick metal layer ("UTM").

11. The differential power divider/combiner of claim 10, wherein the U-RDL and the UTM are coupled to each other using a plurality of redistribution vias.

12. A differential power divider/combiner, comprising:

a first pair of transmission lines coupled between a differential input and a first differential output, wherein a first transmission line and a second transmission line of the first pair of transmission lines comprise a plurality of metal layers, and are disposed to form respective first and second open loops that are adjacent to one another between the differential input and the first differential output, and cross over one another in a first crossover region;

a second pair of transmission lines coupled between the differential input and a second differential output, wherein a third transmission line and a fourth transmission line of the second pair of transmission lines comprise a plurality of metal layers, and are disposed to form respective third and fourth open loops that are adjacent to one another between the differential input and the second differential output, and cross over one another in a second crossover region;

a first resistor coupled between the first transmission line and the third transmission line; and a second resistor coupled between the second transmission line and the fourth transmission line.

13. The differential power divider/combiner of claim 12, wherein:

the adjacent portions of the first open loop and second open loop are arranged substantially parallel to each other and carry respective currents that flow in a same direction so as to constructively contribute to a first magnetic field; and the adjacent portions of the third open loop and the fourth open loop are arranged substantially parallel to each other and carry respective currents that flow in a same direction so as to constructively contribute to a second magnetic field.

14. The differential power divider/combiner of claim 12, wherein:

the first open loop and the second open loop include at least one vertical portion and at least one horizontal portion that are orthogonal to each other; and the third open loop and the fourth open loop include at least one vertical portion and at least one horizontal portion that are orthogonal to each other.

15. The differential power divider/combiner of claim 12, wherein:

the first transmission line and the second transmission line provide respective first and second quarter wave transformers between the differential input and the first differential output; and the third transmission line and the fourth transmission line provide respective first and second quarter wave transformers between the differential input and the second differential output.

16. The differential power divider/combiner of claim 12, wherein the plurality of metal layers comprises two metal layer windings laid over one another and coupled to each other using a plurality of redistribution vias.

17. The differential power divider/combiner of claim 16, wherein a first layer of the metal layer windings comprises an under redistribution layer ("U-RDL") and a second layer of the metal layer windings comprises an ultra-thick metal layer ("UTM").

18. A differential power divider/combiner, comprising:

a first pair of transmission lines coupled between a differential input and a first differential output, wherein a first transmission line and a second transmission line are disposed to form respective first and second open loops that are adjacent to one another between the differential input and the first differential output, and cross over one another in a first crossover region, and wherein the adjacent portions of the first open loop and second open loop are arranged substantially parallel to each other and carry respective currents that flow in a same direction so as to constructively contribute to a first magnetic field;

a second pair of transmission lines coupled between the differential input and a second differential output, wherein a third transmission line and a fourth transmission line of the second pair of transmission lines are disposed to form respective third and fourth open loops that are adjacent to one another between the differential input and the second differential output, and cross over one another in a second crossover region, and wherein the adjacent portions of the third open loop and the fourth open loop are arranged substantially parallel to each other and carry respective currents that flow in a same direction so as to constructively contribute to a second magnetic field;

a first resistor coupled between the first transmission line and the third transmission line; and a second resistor coupled between the second transmission line and the fourth transmission line.

19. The differential power divider/combiner of claim 18, wherein the first transmission line, the second transmission line, the third transmission line, and the fourth transmission line each comprise a plurality of metal layers laid over one another and coupled to each other using a plurality of redistribution vias.

20. The differential power divider/combiner of claim 19, wherein a first layer of the plurality of metal layers comprises an under redistribution layer ("U-RDL") and a second layer of the plurality of metal layers comprises an ultra-thick metal layer ("UTM").

* * * * *